US005503488A

United States Patent [19]

Chinchar

[11] Patent Number: 5,503,488

[45] Date of Patent: Apr. 2, 1996

[54] FILE CARD INTERACTING WITH OTHER, IDENTICAL SUCH CARDS

[76] Inventor: Victor M. Chinchar, 24650 Center Ridge Rd., Westlake, Ohio 44145

[21] Appl. No.: 312,523

[22] Filed: Sep. 26, 1994

[51] Int. Cl.[6] ..... B42F 13/00

[52] U.S. Cl. ..... 402/79; 281/2; 281/38

[58] Field of Search ..... 402/79, 80 R; 281/2, 5, 38, 51; 40/360

[56] References Cited

U.S. PATENT DOCUMENTS 4,849,056 7/1989 Ristuccia, Sr. ..... 402/79

5,007,191 4/1991 Klein ..... 402/79 X 5,020,931 6/1991 Sloot ..... 402/79

5,234,277 8/1993 Le ..... 402/79

*Primary Examiner*—Willmon Fridie

*Attorney, Agent, or Firm*—Paul H. Gallagher

[57] ABSTRACT

A single file card, a plurality of which, all identical, are used in a stack, with adjacent ones arranged oppositely. The card has cut out conformations forming tabs at the side edges, oppositely positioned in adjacent cards. The top edge has tabs including a plurality of small tabs and a single large tab, non-symmetrically arranged to expose inscriptions on alternate cards.

9 Claims, 1 Drawing Sheet

FIG. 2
PRIOR
ART
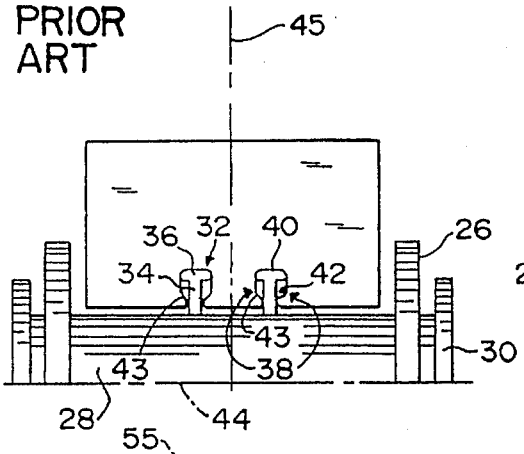
FIG. 1
PRIOR
ART
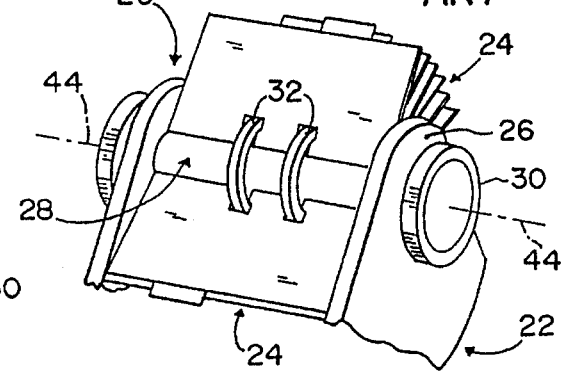
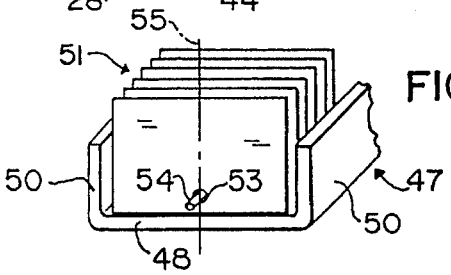
FIG. 3
FIG. 4
PRIOR
ART
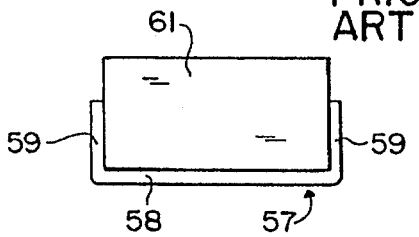
FIG. 5
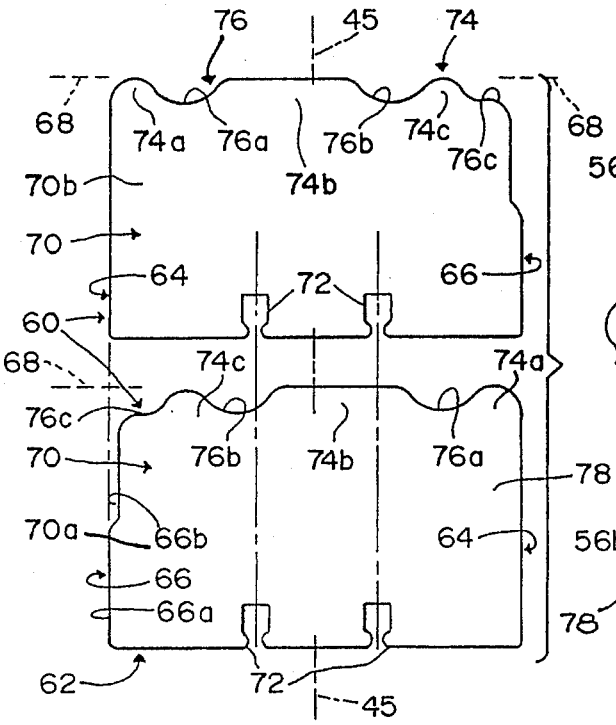
FIG. 6
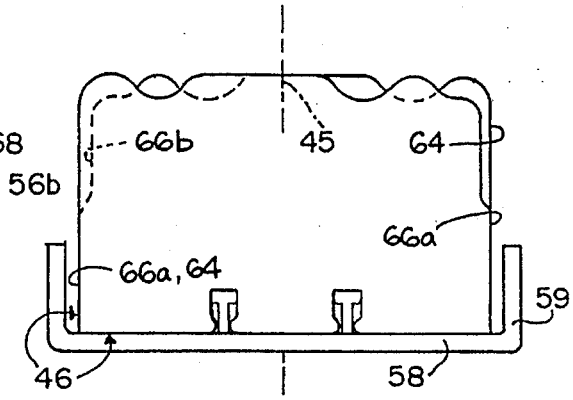
FIG. 7
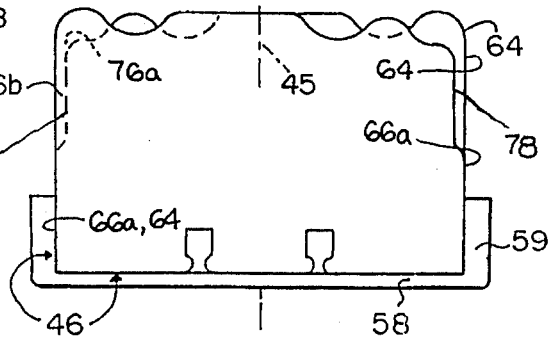

FILE CARD INTERACTING WITH OTHER, IDENTICAL SUCH CARDS

BRIEF SUMMARY OF THE INVENTION

The invention resides in the field of file cards of the kind ordinarily used in a holder or drawer, wherein the cards are inserted and removed individually. In such a system, the cards may be locked, or semi-locked, in place in the drawer, in side-to-side positioning, or they may be loosely put in place, without locking, and in the latter case are confined solely by the surrounding vertical surfaces of the drawer, which may be considered similar to a simple box.

OBJECTS OF THE INVENTION

A broad object of the invention is to provide a novel file card of special shape which, when a plurality of identical such cards are put alternately oppositely in a drawer, each card has conformations exposed on that card relative to adjacent cards for easy access by the user for facilitating handling the cards to find a particular card. Thus a plurality of identical such cards form interacting cards.

Another object is to provide such a file card that a single one, or a plurality of such cards, can be used together with presently known file cards, and nevertheless provide tabs on the cards of the present invention for facilitating handling of the cards.

BRIEF DESCRIPTION OF THE INDIVIDUAL VIEWS OF THE DRAWINGS

FIG. 1 is a perspective view of the top portion of a known card file or card holder of a kind in which the file card of the present invention may be used.

FIG. 2 is face view of the device of FIG. 1.

FIG. 3 is a partial perspective view of another form of card file or drawer.

FIG. 4 is a vertical transverse view of still another card file or drawer.

FIG. 5 shows two cards of the present invention, oppositely faced, the equivalent of two faces of single card.

FIG. 6 is a face view showing two cards, arranged respectively according to the faces of FIG. 5, fitted together in face-to-face relation.

FIG. 7 is a face view showing two cards, arranged as in FIG. 6, in a drawer as shown in FIG. 4.

DETAILED DESCRIPTION

Referring in detail to the drawings, attention is directed first to FIGS. 1 and 2, showing a card file 20 of known kind, having a casing or a housing 22 in which are mounted a plurality of cards 24, which as shown in FIGS. 1 and 2 may be conventional. The card file or holder includes side elements 26 which may be referred to as side walls. The cards 24 are mounted on a roller 28 having external knobs 30 for turning the roller. The roller is provided with two tracks 32 for releasably holding the file cards.

The tracks 32 may be also referred as rails, being T-shape in cross section (FIG. 2), and each containing a web 34 secured to the roller and extending therefrom, in this case radially, and a flange 36.

For convenience the cards are referred to as oriented in FIG. 2, i.e., disposed vertically. The cards have slots or notches 38 shaped according to the traces, each having a radially inner transverse portion 40 and a radial or vertical portion 42 which opens out through the bottom edge of the cards. The slot thus includes tabs 43 (FIG. 2) extending inwardly, under the flange 36 when the cards are in place, for holding the cards in place in the normal use of the card file.

The tracks 32 are spaced along the axis 44 of the roller for locating the file cards at the desired position transversely in the holder, i.e. in side-to-side position. Such position is that in which the cards are centered relative to the side walls 26, and to a center line or central vertical axis 45 (FIG. 2). The cards, that is, a plurality of cards, are thereby all held in the same side-to-side position, with the cards registering with one another according to their outline shape, as will be referred to in detail hereinbelow.

The file cards may be of any of various dimension, such as 3" ×5" which may also be considered a standard size.

While in the holder 20, referred to above, the cards are held therein by the tracks or rails 32. FIG. 3 shows another form of file holder in which the cards of the invention may be placed. In FIG. 3 a drawer 47 is shown, which is also of standard type, and which may be a simple straight longitudinal drawer, in the shape of a box, having a bottom element 48, and side walls 50. Cards 51 are arranged in a stack in the box, and provided with a single hole 53 at the center and near the bottom. This hole is defined by a continuous marginal edge and does not open through the bottom edge of the card. A locking rod or wire 54 is mounted in the drawer, and to insert or remove the cards, the rod is withdrawn, a card inserted or removed, and the rod again put in place, the rod holding the cards transversely Centered, side-to-side, relative to the vertical center line 55.

FIG. 4 shows another form of file drawer, 57, similar to the file drawer 47 of FIG. 3, but without the locking rod 54, the drawer 57 having a bottom element 58 and side walls 59. Cards, including conventional cards 61 are placed in the drawer in simple upright position and retained in position transversely by engagement with the side walls of the drawer. In this kind of file, the most common size of card used is 3"×5" referred to above.

The file holders or drawers shown in FIGS. 1–4 are of conventional nature, and it is pointed out that the file card of the present invention is adapted to use in any of these file drawers. The cards are maintained centered, in a common side-to-side position relative to one another by the various elements of these different kinds of holders, namely the rails 32 of FIGS. 1 and 2, the rod 54 of FIG. 3, and the side walls of FIG. 4. In the latter case, center holes may be provided to receive the rod 54, if it should be desired to use the same card selectively in the drawers 47, 57. The following description is directed to the specific construction of the file cards, and their necessary relation to the elements of the holders, when they are placed in the holders.

FIGS. 5 and 6 show a file card 60 incorporating the features of the invention, and in these Figures, each file card will assume different positions, in the use thereof, and to facilitate recognition of the various elements in the different positions, the edges of the cards are identified. In the lower illustration of FIG. 5, the card has be bottom edge 62, right hand edge 64, left hand edge 66, and top edge 68, and each card has faces 70, opposite ones being individually identified **70*a*, 70*b*. FIG. 5 Shows two file cards with opposite faces so presented, the equivalent of a single card with its opposite faces presented, in this figure the face 70*a* being shown at the bottom and 70*b*** at the top.

Each card has notches 72 cut in its bottom edge similar to the notches 38. The right hand edge 64 is a continuous straight edge from the bottom edge up to nears the top edge, while in the case of the left hand edge 66, the lower portion 66*a* extends only partially up to the top, in this case approximately half the distance, while the upper portion 66*b* extends through the upper part, approximately the upper half, to adjacent the top edge.

The bottom edge 62, the right hand edge 64, and the lower portion 66*a* of the left side edge, define three sides of a regular rectangle, to be referred to again hereinbelow. The bottom edge 62 except for the notches 72 and rounded corners at the junctions with the side edges, extends throughout the width of the card. These junctures are referred to as Corners of the rectangle. It is pointed out that the main portion of the bottom edge just referred to continues in a straight line, except for the notches, and thus continues effectively throughout the width of the card. The upper segment 66*b* of the left hand edge is offset relative to the lower segment in inward direction. This upper segment therefore lies within the rectangle defined by the other three edges referred to. The right hand edge 64, and the left hand edge segment 66*a* define the opposite borders of the rectangle referred to, and thus are symmetrical about the central vertical axis 45. The notches 72 are also symmetrical about that axis, and thus when the card is put in the holder of FIGS. 1 and 2, it is centered between the side walls 26. The cards are thus secured in place, in side-to-side orientation, by the rails, or by the rod 54 or by the side walls. In any case the bottom edge substantially or effectively rests on the bottom of the holder. If desired, the cards may be made without the bottom notches or holes so that it can be used in the holder or box of FIG. 4.

The top edge of the card is provided with a series of tabs 74 and voids or spaces 76 therebetween, the tabs being individually identified 74*a*, 74*b*, 74*c*, and the voids or spaces 76*a*, 76*b*, 76*c*.

These tabs and voids are non-symmetrically arranged relative to the central axis 45, for respective cooperation between the elements on adjacent cards (FIG. 5). The side face 70*a* is arbitrarily referred to as the first side, and the other side 70*b*, the second side.

The tabs 74 and voids 76 are all at the top of the card, that is, the upper tips of the tabs lie in the top edge 68. The tab 74*a* (lower card, FIG. 5) continues from the right side edge 64 and leads into the first void 76*a;* Continuing to the left, the tab 74*b* is relatively broad, and may be substantially the equivalent of two tabs 74*a* and an intervening void. Then follows the void 76*b*, the tab 74*c*, the latter leading into the void 76*c*, the latter void thus being of lesser extent of the others, and the bottom edge of that void leads into the edge segment 66*b*.

The cards are put in place alternately oppositely, as stated, with opposite faces on adjacent cards in mutual engagement. Accordingly the tabs, for the most part, on one card are aligned with voids on the other card. In the case of the two broad tabs 74*b*, on the two cards, each overlaps the other approximately one-half of its transverse width, but that tab in the rear is partially viewable to the observer. The advantage of the greater width of this tab is that more information can be imprinted thereon than in the case of a small tab (74*a*), and even though the one tab is partially covered or obstructed, the remaining portion that is viewable provides greater capacity for including longer titles and additional information. The alternate exposure on two adjacent cards facilitates the users manipulation of the cards for segregating or exposing a particular card. This relation between the tabs and voids is best shown in FIG. 6.

The cards are arranged in the holder throughout a series, which may be referred to as a stack, even though they are arranged essentially in vertical position with their top edges disposed upwardly. This is true even in the case of a rotary holder as in FIGS. 1 and 2, because it is those cards at the top that are regarded in any manipulation, and in that position they are arranged close to the vertical.

The tabs and voids along the top edge not only are non-symmetrical relative to the central axis 45, but they are arranged so that when they are placed in the holder in the stack, the full right side edge 64 in one card is aligned, transversely, with the lower edge segment 66*a* on the adjacent card. This provides a portion 78 of the upper part of the right side edge, which forms a side tab, which registers with the space 79 provided by the offset of the upper edge segment 66*b* in the adjacent card. The broad tabs 74*b* and the side edge tabs 78 provide greater facility in manipulating the cards and are in keeping with the intent of the Americans With Disabilities Act, for assisting semi-incapacitated persons. It will be understood that not only are the wide or broad tabs 74*b* used for inscriptions, but all the tabs 74 are so used.

The construction of FIG. 3 shows the use of the holes 53 and a rod 54 for holding the cards in the holder. In this construction, the cards are otherwise the same as in FIGS. 5 and 6, the upper portions of the cards being omitted.

Referring to FIG. 7, this Construction shows a simple holder in the form of a box, without special means for holding the cards in place, such as the rails 32 Of FIG. 2 or rod 54 of FIG. 3. The cards rest on the bottom 58 of the holder and engage the side walls 59 of the holder and are held in place in that manner.

I claim:

1. A file card for use in a card file that includes a drawer for holding a plurality of cards in a stack in mutual face-to-face relation with the cards in upright position, each card having a bottom edge, a right side edge, a left side edge, and a top edge, and a vertical axis centrally of the side edges, the drawer having a transverse direction orientated side-to-side, the drawer including limiting means engaged by the cards for pre-positioning the cards in side-to-side position, wherein, the bottom edge and the side edges of the card having main portions lying in and defining a common rectangle, the bottom edge joining at a corner with each side edge and the main portion of the bottom edge constituting the main lowermost limit of the card, the card having a plurality of tabs distributed along the top edge with voids between adjacent tabs, the tabs on each card being asymmetrical relative to the central axis, whereby when a plurality of identical such cards are placed together alternately oppositely face-to-face, each tab is so positioned as to be exposed at least partially through a corresponding void in an adjacent card.

2. A file card according to claim 1 wherein, the tabs include at least one tab that is relatively broad in direction longitudinally of the top edge, and at least one tab that is relatively narrow in said direction, and said voids are of uniform dimension in said direction.

3. A file card according to claim 1 wherein, the right side edge extends nearly the height of the card, and its upper portion forms a side tab, the left side edge has a side void in the upper portion of the card, whereby, when the cards are placed together as stated, the side tab is in register with the side void in an adjacent card.

4. A file card according to claim 3 wherein, in the top edge one of the voids is a left end void that merges with the side void, forming a continuous void, and a short tab next to the left end void.

5. A file card according to claim 4 wherein, the top edge includes a right end short tab adjacent to and merging into the side tab, whereby said short tabs together are asymmetrical relative to said central axis, and the right end short tab and the side tab together are in register with said continuous void.

6. A file card according to claim 3 wherein, the tabs on the top edge terminate upwardly in a common straight line parallel with the bottom edge.

7. A file card according to claim 3 wherein, the bottom edge thereof has a pair of notches for engagement with rails in a holder, the notches being symmetrical about a vertical axis centrally between the side edges.

8. A file card according to claim 3 wherein, the card has a single hole near the bottom edge for engagement with a locking rod in a holder, the hole being midway between the side edges.

9. A file card according to claim 5 wherein, the top edge includes only two said short tabs, the top edge includes a single broad tab spaced centrally between the short tabs, whereby in adjacent oppositely faced cards, the broad tabs are offset transversely relative to each other, and they are only partially so offset and they partially overlie each other.

* * * * *